US006782562B1

(12) United States Patent
Aono

(10) Patent No.: US 6,782,562 B1
(45) Date of Patent: Aug. 31, 2004

(54) TOILET SEAT WITH WASHING MACHINE

(75) Inventor: Yukihiko Aono, Hamamatsu (JP)

(73) Assignee: Aono Co., LTD, Shizuoka-ken (JP)

( * ) Notice: Subject to any disclaimer, the term of this patent is extended or adjusted under 35 U.S.C. 154(b) by 0 days.

(21) Appl. No.: 10/465,609

(22) Filed: Jun. 20, 2003

(30) Foreign Application Priority Data

Feb. 12, 2003 (JP) ..... 2003-033769

(51) Int. Cl.[7] ..... E03D 9/08
(52) U.S. Cl. ..... 4/420.4
(58) Field of Search ..... 4/420.4

(56) References Cited

U.S. PATENT DOCUMENTS 4,704,748 A * 11/1987 Takeda et al. ..... 4/420.4
5,369,817 A * 12/1994 Iguchi ..... 4/448
5,647,069 A * 7/1997 Han et al. ..... 4/420.2
5,953,765 A * 9/1999 Hayashi et al. ..... 4/420.4
6,618,865 B1 * 9/2003 Kim ..... 4/420.4
2003/0140407 A1 * 7/2003 Matsumoto et al. ..... 4/420.4

* cited by examiner

*Primary Examiner*—Charles E. Phillips
(74) *Attorney, Agent, or Firm*—Bacon & Thomas PLLC

(57) ABSTRACT

To make a toilet seat with a washing machine inexpensive and enhance its safety, it comprises a support plate (6) provided in a rear portion of the toilet seat (2), an injection pipe (10) provided in the support plate (6) so as to freely come out forward from the rear portion of the toilet seat (2), an arm (15) provided in the support plate (6), the arm protruding forward in one side portion of the toilet seat (2), an operation device (16) provided in the arm (15) so as to freely move forward and backward, an interlocking mechanism (20) interlocking the forward and backward movement of the operation device (16) with the forward and backward movement of the injection pipe (10), a water stop valve (30) provided in the support plate (6), the water stop valve allowing to supply water to the injection pipe (10) and shutting the water supply, and a link mechanism (32) provided between the operation device (16) and the water stop valve (30), the link mechanism interlocking the forward and backward movement of the operation device (16) with the opening and closing operation of the water stop valve (30).

5 Claims, 8 Drawing Sheets

TOILET SEAT WITH WASHING MACHINE

BACKGROUND OF THE INVENTION

1. Field of the Invention

The present invention relates to a toilet seat with washing machine which washes a defecation portion of a user with water.

2. Description of Conventional Art

A conventional washing machine mounted to a toilet seat is structured such that an injection pipe thereof is moved forward and backward by a motor, and a water stop valve supplying water to the injection pipe is opened and closed by an electromagnetic valve.

In the conventional structure mentioned above, since the washing machine can be operated only by operating a predetermined switch, an operation can be easily and simply carried out. However, since special devices and control parts are required and an electricity is required for a power source, the structure becomes expensive, a maintaining cost is high, and safety is infufficient. An object of the present invention is to provide a novel toilet seat with a washing machine which can solve the defect mentioned above, by making a structure such that the washing machine can be driven by a simple manual operation.

SUMMARY OF THE INVENTION

In order to achieve the object mentioned above, the present invention is structured as follows. That is, in accordance with a first aspect of the present invention, there is provided a toilet seat with a washing machine comprising:

a support plate provided in a rear portion of the toilet seat;

an injection pipe provided in the support plate so as to freely come out forward from the rear portion of the toilet seat and return;

an arm provided in the support plate, the arm protruding forward in one side portion of the toilet seat;

an operation device provided in the arm so as to freely move forward and backward;

an interlocking mechanism interlocking the forward and backward movement of the operation device with the forward and backward movement of the injection pipe;

a water stop valve provided in the support plate, the water stop valve allowing to supply water to the injection pipe and shutting the water supply; and a link mechanism provided between the operation device and the water stop valve, the link mechanism interlocking the forward and backward movement of the operation device with the opening and closing operation of the water stop valve.

In accordance with a second aspect of the present invention, there is provided a toilet seat with a washing machine, in which the interlocking mechanism is structured such as to comprise a drive rack and a driven rack respectively provided in the operation device and the injection valve, a primary pinion and a secondary pinion engaging with the drive rack and the driven rack, and a transmission device for transmitting a rotation of the primary pinion to the second pinion.

In accordance with a third aspect of the present invention, there is provided a toilet seat with a washing machine, in which the interlocking mechanism is structured such that a laterally extending operation lever is provided between the operation device and the injection pipe, a laterally middle portion of the operation lever is connected to the support plate so as to freely rotate around a vertical axis, and one end portion of the operation lever and another end portion thereof are respectively connected to the operation device and the injection pipe so as to freely rotate around the vertical axis.

In accordance with a fourth aspect of the present invention, there is provided a toilet seat with a washing machine, further comprising a balance lever extending to the opposite side to the operation lever from the injection pipe, wherein one end portion of the balance lever and another end portion thereof are respectively connected to the injection pipe and a side of the support plate so as to freely rotate around a vertical axis.

In accordance with a fifth aspect of the present invention, there is provided a toilet seat with a washing machine, wherein the water stop valve is constituted by a ball water stop valve.

DESCRIPTION OF THE PREFERRED EMBODIMENTS

Figure 4:
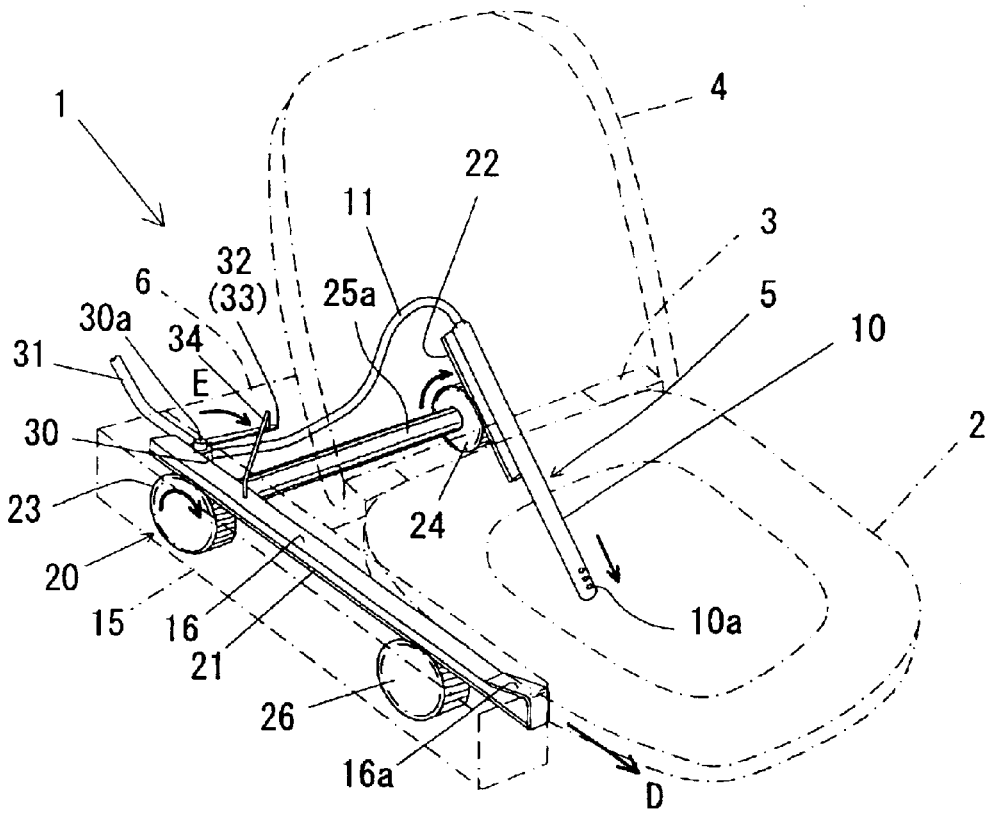
FIG. 4 is a perspective view for describing a second embodiment in accordance with the present invention.
Figure 5:
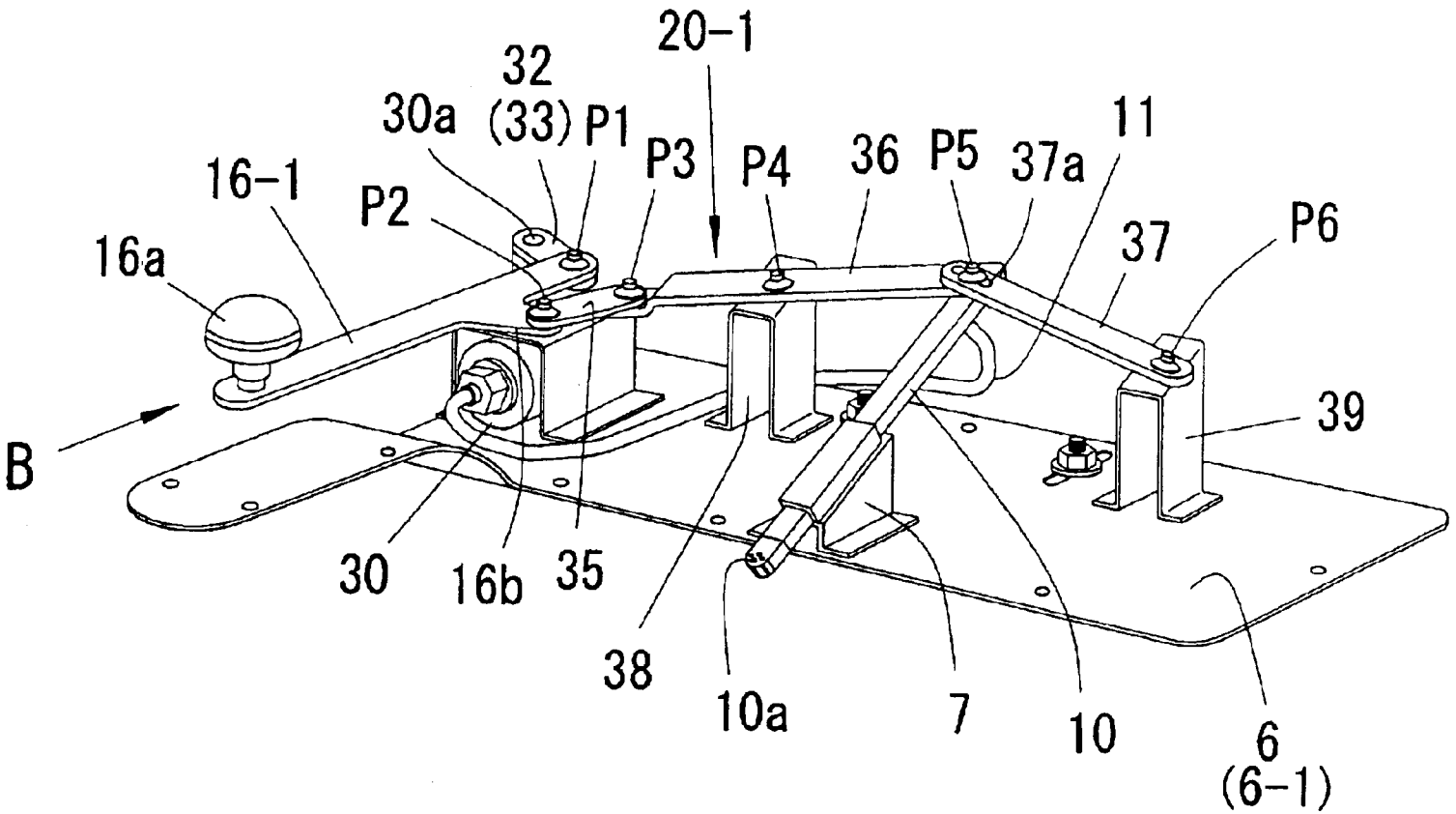
FIG. 5 is a perspective view of a main portion at an initial time of an operation by a third embodiment in accordance with the present invention.
Figure 6:
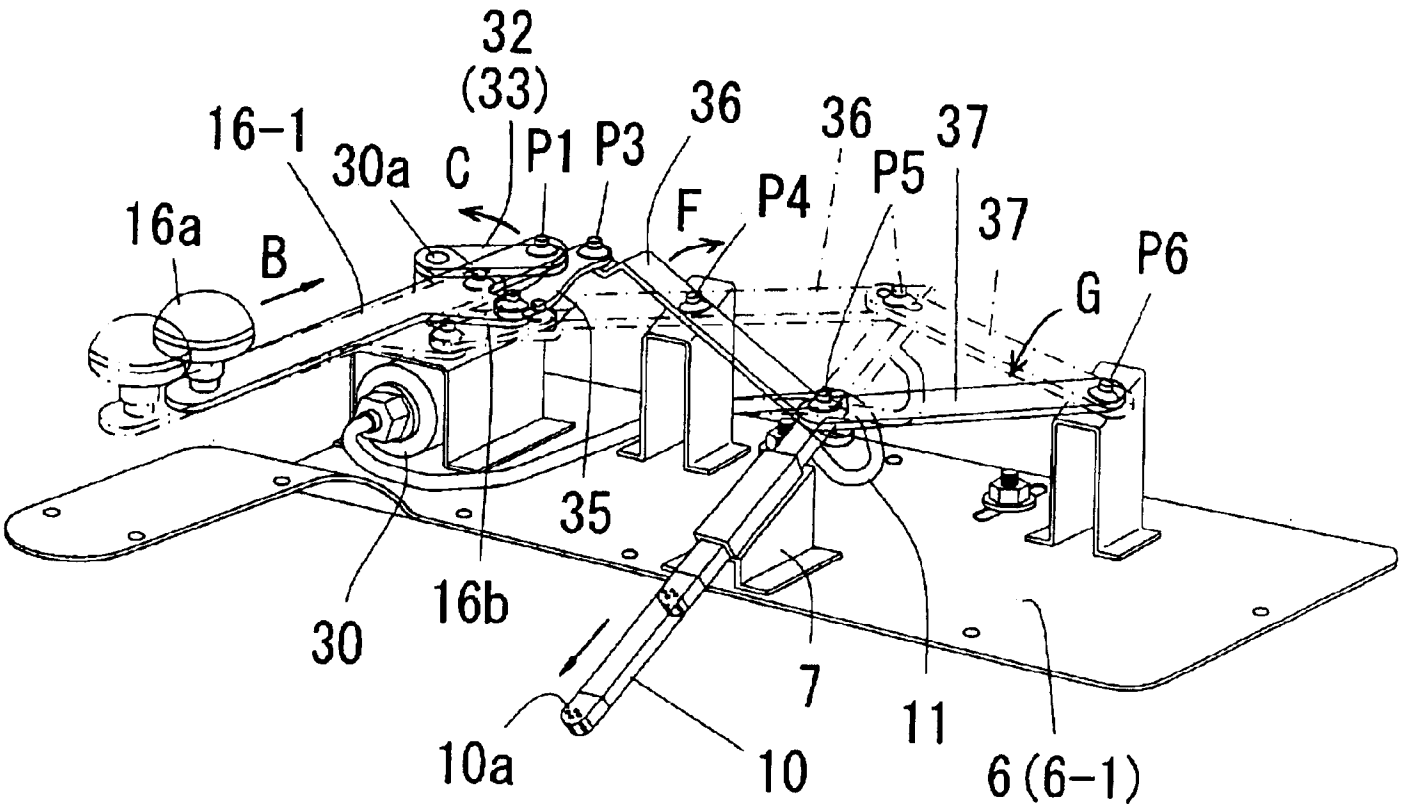
FIG. 6 is a perspective view of a main portion showing a state of the operation by the third embodiment in accordance with the present invention.
Figure 7:
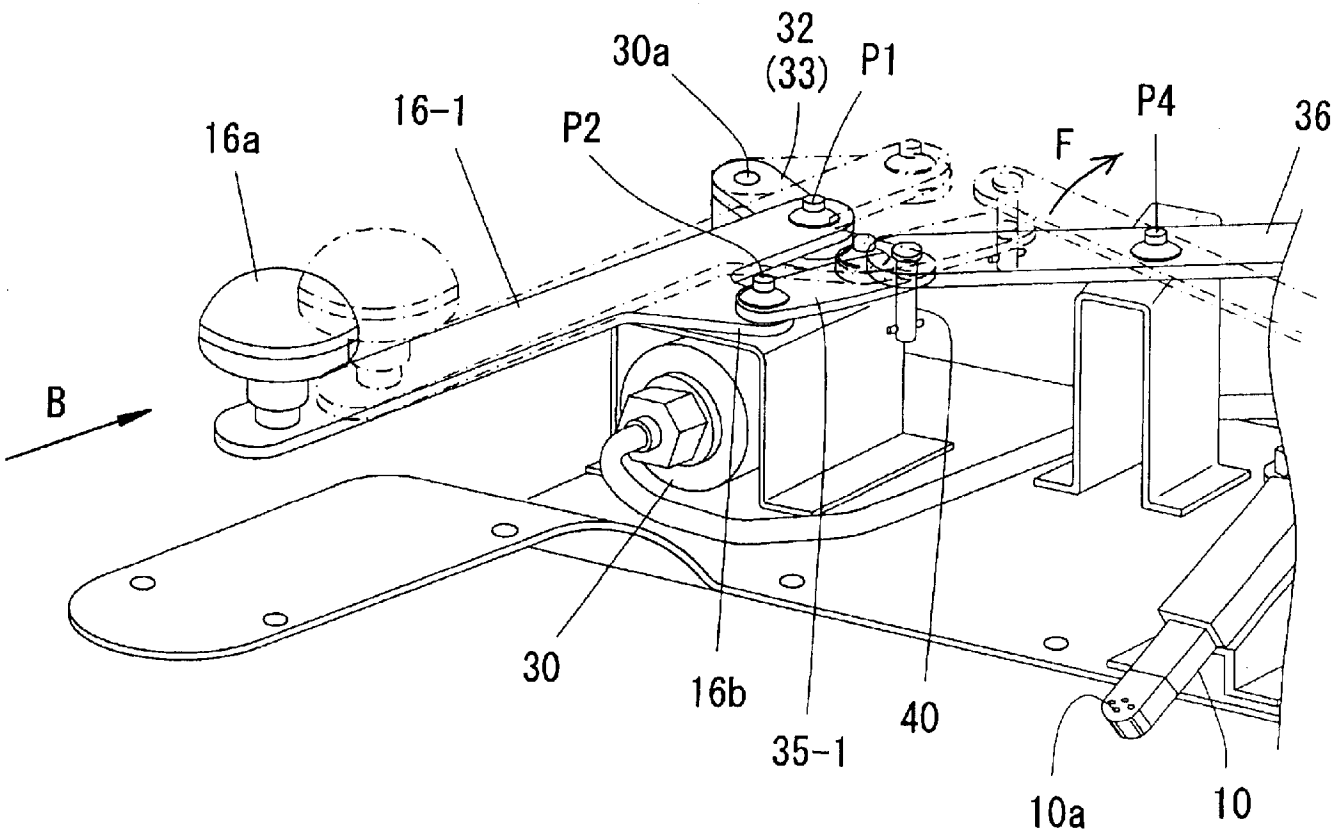
FIG. 7 is a partly enlarged perspective view showing a fourth embodiment in accordance with the present invention.
Figure 8:
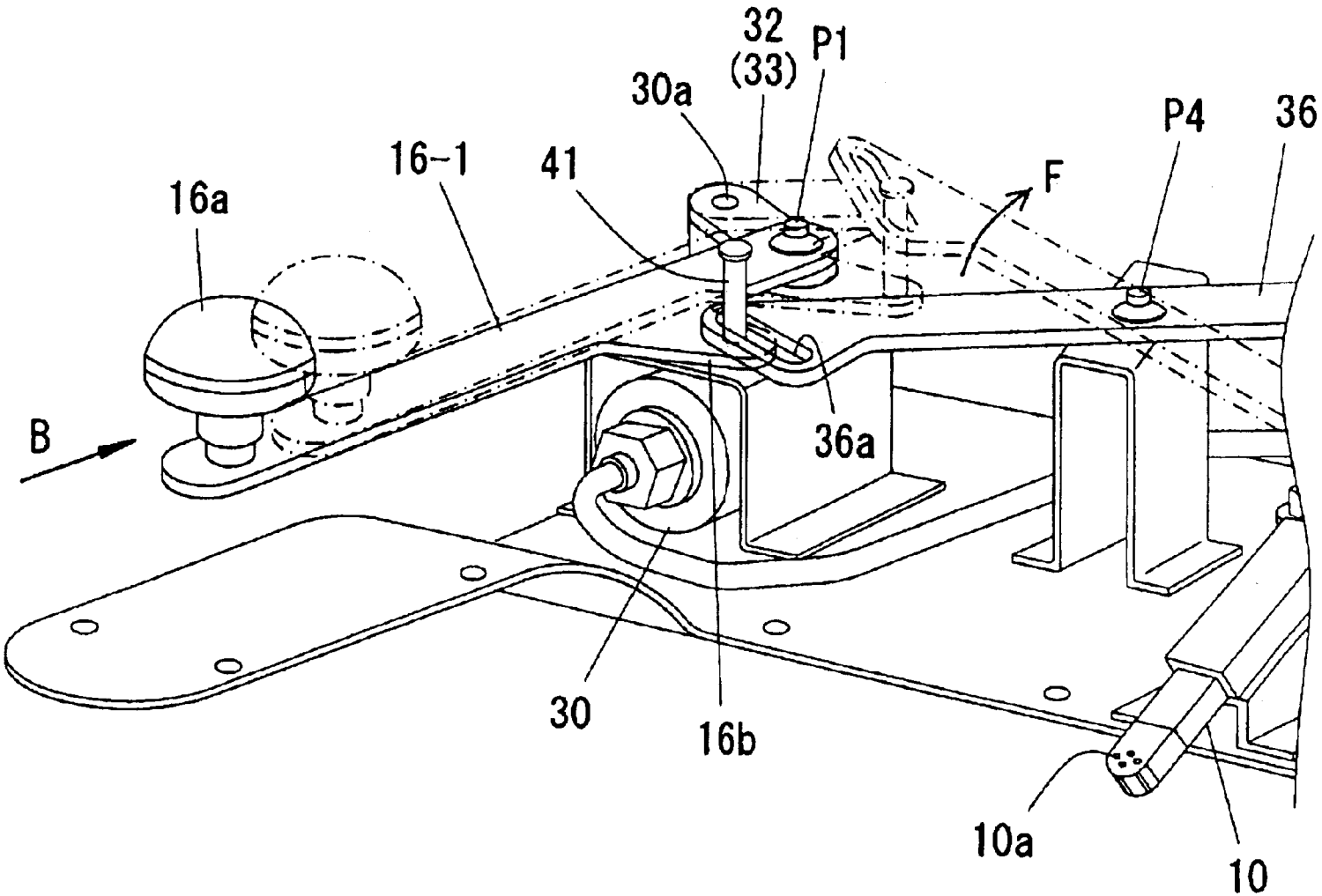
FIG. 8 is a partly enlarged perspective view showing a fifth embodiment in accordance with the present invention.

A description will be given below of embodiments in accordance with the present invention with reference to he accompanying drawings. In the drawings, FIG. 1 is a perspective view of a toilet seat with a washing machine to which the present invention is applied, FIG. 2 is a perspective view for describing a first embodiment in accordance with the present invention, FIG. 3 is a partial plan view of FIG. 2, FIG. 4 is a perspective view for describing a second embodiment in accordance with the present invention, FIG. 5 is a perspective view of a main portion at an initial time of an operation by a third embodiment in accordance with the present invention, FIG. 6 is a perspective view of a main portion showing a state of the operation by the third embodiment in accordance with the present invention, FIG. 7 is a partly enlarged perspective view showing a fourth embodiment in accordance with the present invention, and FIG. 8 is a partly enlarged perspective view showing a fifth embodiment in accordance with the present invention.

Figure 1:
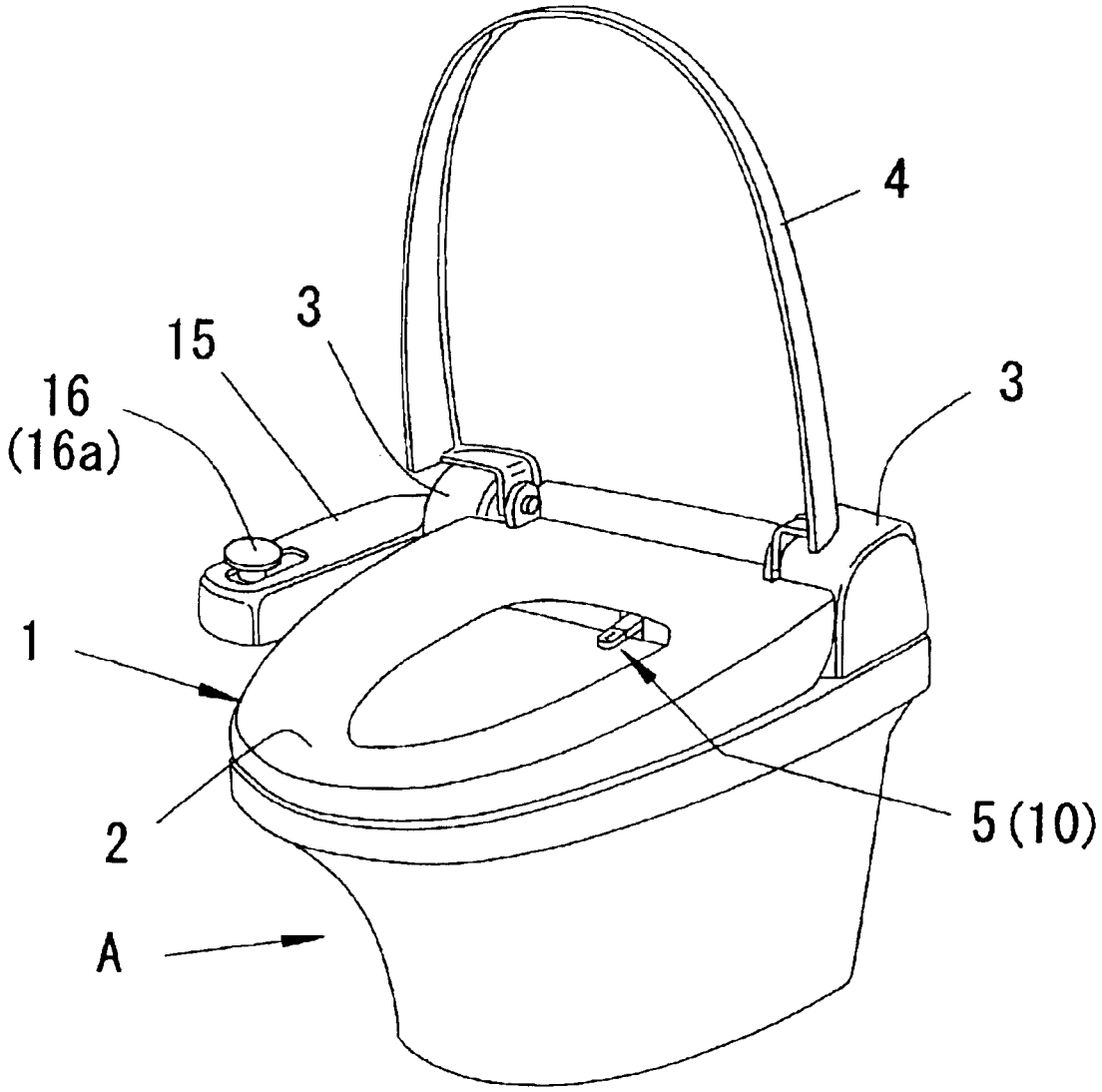
FIG. 1 is a perspective view of a toilet seat with a washing machine to which the present invention is applied.
Figure 2:
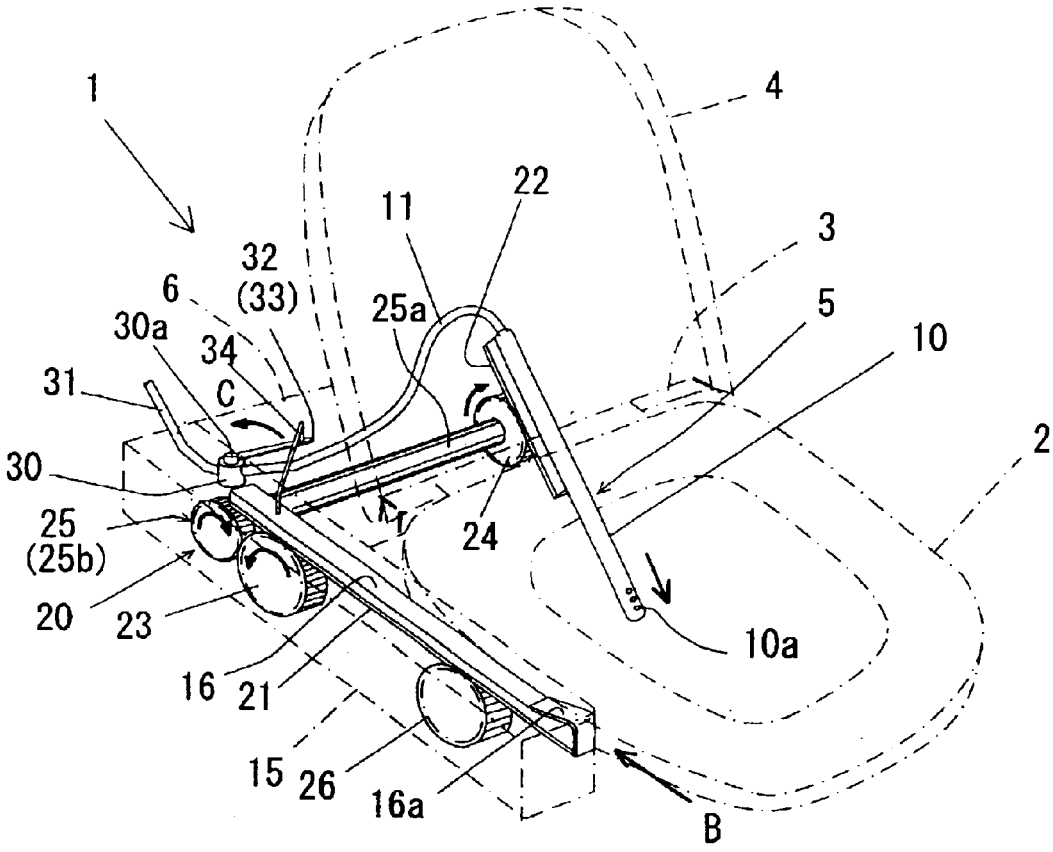
FIG. 2 is a perspective view for describing a first embodiment in accordance with the present invention.

In FIG. 1, reference symbol A denoted a western style toilet, reference numeral 1 denotes a toilet seat with a washing machine mounted to the toilet A, reference numeral 2 denotes a toilet seat, and reference numeral 5 denotes a washing machine. The toilet seat 2 is formed in a ring shape in a plan view, and is mounted to a holder 3 in a side of a rear portion thereof so as to freely rotate upward and downward. The holder 3 is fixed to a rear upper surface of the toilet A via a support plate 6. Reference numeral 4 denotes a cover. The cover 4 is mounted to the holder 3 in a side of a rear portion thereof so as to freely rotate upward and downward, and covers the toilet seat 2 from the above.

Figure 3:
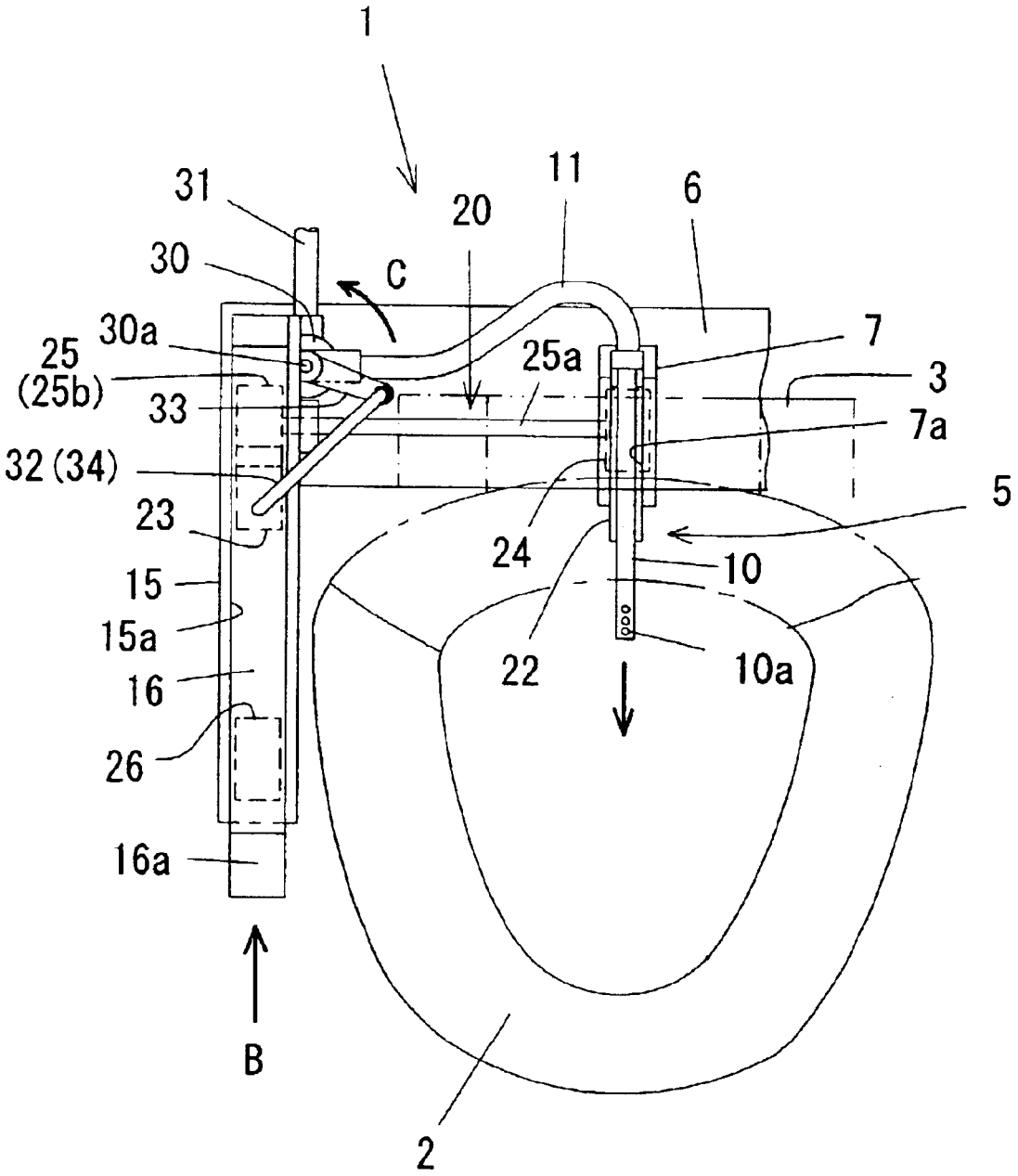
FIG. 3 is a partial plan view of FIG. 2.

The washing machine 5 is structured as shown in FIG. 3. That is, the support plate 6 which is elongated in the lateral direction is arranged in a rear portion of the toilet A so as to be fixed by being fastened with bolts, a bracket 7 (FIG. 3) is fixed to a center portion in the lateral direction of the support plate 6 in an uprising manner, and an elongated arm 15 is fixed to a left end portion in FIG. 3 so as to protrude forward. The bracket 7 is formed in a triangular shape in a side view so that an upper surface of the bracket 7 is downward inclined toward the front side from a rear portion, and a guide 7*a* which is downward inclined toward the front side is formed on an upper surface thereof.

An injection pipe 10 is fitted to the guide 7*a* so as to freely slide forward and backward. This injection pipe 10 is structured such that the front end is closed, a plurality of injection ports 10*a* are formed on the upper surface of the front end portion, water supply hose 11 is connected to a rear end portion, and a water supplied from the supply hose 11 is injected upward from the injection ports 10*a*. Further, the arm 15 is extended in the back and forth direction in a left side portion of the toilet seat 2 in FIG. 3, is formed in a box shape, and has a guide 15*a* which is elongated in the back and forth direction on an upper surface of the arm 15. A plate-like operation device 16 which is elongated in the back and forth direction is slidably fitted to the guide groove 15*a*.

There is provided with an interlocking mechanism 20 which interlocks a forward and backward movement of the operation device 16 with a forward and backward movement of the injection pipe 10. That is, as shown in FIG. 2, a drive rack 21 and a driven rack 22 which extend in the back and forth direction are respectively mounted to a lower surface of the operation device 16 and a lower surface of the injection pipe 10, and the drive rack 21 is engaged with a primary pinion 23 and a floating pinion 26 which are rotatably mounted to a rear portion and a front portion within the arm 15. Further, the driven rack 22 is engaged with a secondary pinion 24 mounted to the bracket 7 mentioned above. Further, the primary pinion 23 and the secondary pinion 24 are connected by a transmission device 25.

The transmission device 25 mentioned above is constituted by a transmission shaft 25*a* and a reversal pinion 25*b*, and the reversal pinion 25*b* is coaxially arranged with the secondary pinion 24 and rotatably mounted within a rear portion of the arm 15, and is engaged with a rear portion of the primary pinion 23. Further, the transmission shaft 25*a* is arranged between axial center portions of the reversal pinion 25*b* and the secondary pinion 24, and both ends thereof are integrally connected to both the pinions. Accordingly, the reversal pinion 25*b* is rotated forward and backward via the primary pinion 23 by moving forward and backward the operation device 16, the secondary pinion 24 is rotated forward and backward via the transmission shaft 25*a*, and the injection pipe 10 mentioned above is then moved in the direction of back and forth via the driven rack 22. Reference symbol 16*a* denotes a wedge-shaped operation piece mounted to an upper surface of a front end portion of the operation device 16. The operation piece 16*a* is structured such as to make a forward and backward movement of the operation device 16 easy by a user laying his or her hand (right hand) thereon.

A water stop valve (a ball water stop valve) 30 is mounted to the support plate 6 mentioned above, an introduction hose 31 connected to a water pipe is connected to the inlet side of the water stop valve 30, and the supply hose 11 mentioned above is connected to the outlet side thereof. A link mechanism 32 for operating so as to open and close the water stop valve 30 in accordance with the forward and backward movement of the operation device 16 is provided between the water stop valve 30 and the operation device 16. That is, a lever 33 is fixed to a valve shaft 30*a* of the water stop valve 30 so as to protrude to the right side in FIG. 3, and the rear end of a link rod 34 is rotatably connected to the leading end (the right end) of the lever 33. Then, the link rod 34 is tilted forward and outward with respect to the lever 33, and the leading end thereof is rotatably connected to the operation device 16.

In this case, the water stop valve 30 is structured such as to be opened by being rotated counterclockwise (the direction of an arrow C) in FIG. 3, and be closed by being rotated clockwise. Further, lengths and a crossing angle of the lever 33 and the link rod 34 are set so that the water stop valve 30 is opened or closed on the basis of a moving amount (stroke) in the direction of back and forth of the operation device 16.

Next, a description will be given of an operation aspect of the first embodiment mentioned above. First, when the user moves the operation device 16 in a direction of an arrow B (backward) as shown in FIG. 3 after defecating, the primary pinion 23 rotates in the counterclockwise direction in FIG. 2, the reversal pinion 25*b* rotates in the clockwise direction, the secondary pinion 24 rotates in the clockwise direction via the transmission shaft 25*a*, the driven rack 22 is moved to the front side by the secondary pinion 24, and accordingly the injection pipe 10 is moved to the front side, whereby the injection port 10*a* is exposed to the inside of the toilet A. Further, interlocking with this, the link rod 34 is pressed back, whereby the lever 33 is rotated in the direction of an arrow C (backward), so that the water stop valve 30 is operated to be opened. Accordingly, the washing water flows from the introduction hose 31 to the supply hose 11 so as to be supplied to the injection pipe 10, and is injected from the injection port 10*a* upward, thereby washing the defecation portion of the user mentioned above. In this case, the movement of the operation device 16 in the direction of the arrow B (backward) (the washing operation) is carried out in a direction in which the user pulls by hand in a sitting state, that is, a direction in which a force is easily applied, so that the washing operation is easily carried out.

Next, when the user moves the operation device 16 mentioned above in the direction opposite to the arrow B (forward) in FIG. 3, the primary pinion 23 rotates in the clockwise direction in FIG. 2, the reversal pinion 25*b* rotates in the counterclockwise direction, the secondary pinion 24 rotates in the leftward direction via the transmission shaft 25*a*, the driven rack 22 is moved to the rear side by the secondary pinion 24, and accordingly the injection pipe 10 is moved to the rear side, whereby the injection port 10*a* retracts from the inside of the toilet A. Further, interlocking with this, the link rod 34 is pulled forward, whereby the lever 33 is rotated in the direction opposite to the arrow C (forward), so that the water stop valve 30 is operated to be closed, and the washing water supply to the injection pipe 10 is stopped. In this case, the structure may be made such that a spring for moving and energizing the operation device 16 to the front side is provided, and the operation device 16 is moved to the front side, that is, returned to the initial position by a spring force at a time when the user releases the operation device 16.

FIG. 4 shows a second embodiment in accordance with the present invention. This structure is made such that the reversal pinion 25*b* mentioned above is omitted, the primary pinion 23 is rotatably mounted within the rear portion of the arm 15 and coaxially arranged with the secondary pinion 24 mentioned above, the primary pinion 23 and the secondary pinion 24 are connected by the transmission shaft 25*a*, and the movement of the water stop valve 30 is set in an inverse manner to that mentioned above, that is, the water stop valve 30 is opened in the case that the lever 33 is rotated in a direction of an arrow E (clockwise) in FIG. 4, and the water stop valve 30 is closed in the case that the lever 33 is rotated in the counterclockwise direction. The others have approximately the same structures as those of the first embodiment mentioned above.

In accordance with the second embodiment mentioned above, when moving the operation device 16 in the direction of an arrow D (forward) as shown in FIG. 4, the primary pinion 23 rotates in the clockwise direction, the secondary pinion 24 rotates in the clockwise direction via the transmission shaft 25*a*, the driven rack 22 is moved to the front side by the secondary pinion 24, and accordingly the injection pipe 10 is moved to the front side, whereby the injection port 10*a* is exposed to the inside of the toilet A. Further, interlocking with this, the link rod 34 is pulled forward, whereby the lever 33 is rotated in the direction of the arrow E, so that the water stop valve 30 is operated to be open. Accordingly, the washing water (service water) is supplied to the injection pipe 10, and the washing water is injected from the injection port 10*a* toward the defecation portion of the user.

Next, in the case of moving the operation device 16 in the direction opposite to the arrow D (rearside) in FIG. 4, the primary pinion 23, the transmission shaft 25*a* and the secondary pinion 24 rotate in the opposite direction to that mentioned above, the injection pipe 10 is moved to the rear side via the driven rack 22, and the injection port 10a is retracted from the toilet. Further, interlocking with this, the link rod 34 is pressed to the rear side, the lever 33 is rotated in the direction opposite to the arrow E (rearward), and the water stop valve 30 is operated so as to be closed, whereby the washing water supply to the injection pipe 10 is stopped.

In this case, the floating pinion 26 may be replaced by a roller or a backing plate. In this case, a lower surface of the operation device 16 in a front side which is brought into contact with the roller or the backing plate is formed as a smooth surface.

FIGS. 5 and 6 show a third embodiment. In FIGS. 5 and 6, reference numeral 6-1 denotes a base plate of the support plate 6. The same injection pipe 10 as that mentioned above is mounted to a center portion in the lateral direction of the base plate 6-1 via the bracket 7 so as to freely slide in the direction of back and forth, and the same water stop valve 30 as that mentioned above is mounted to a left portion thereof. The lever 33 is fixed to the valve shaft 30*a* of the water stop valve 30 so as to be directed rightward, and an operation device 16-1 is rotatably connected to a right end portion of the lever 33 via a pin P1.

The operation device 16-1 is extended out, and has a connection piece 16*b* protruding to the right side in a side of a rear portion of the operation device 16-1. A front end portion of a soft link plate 35 arranged in the direction of back and forth is rotatably connected to the connection piece 16*b* via a pin P2. A first lever bracket 38 is fixed to the base plate 6-1 positioned in a middle portion between the operation device 16-1 and the injection pipe 10 in an upstanding manner, and a center portion of an operation lever 36 extending to the lateral direction is rotatably connected to an upper surface of the first lever bracket 38 via a pin P4. The upper surface of the first lever bracket 38 is inclined forward down by the same angle as an angle of forward down incline in the injection pipe 10, whereby the operation lever 36 is rotated around a forward inclined vertical axis.

The operation lever 36 is provided with an oblong hole (not shown) which is long in a lateral direction, in a right end portion thereof, and is rotatably connected to a rear end portion of the injection pipe 10 mentioned above via the oblong hole by a pin P5. Further, a left end portion of the operation lever 36 is stepped and twisted to be horizontal, and the left end portion is rotatably connected to a left end portion of the link plate 35 via the pin P3.

A second lever bracket 39 is fixed to a right end portion of the base plate 6-1 mentioned above in an uprising manner, and a right end portion of a balance lever 37 extending to the opposite side to the operation lever 36 mentioned above is rotatably connected to an upper surface of the second lever bracket 39 via a pin P6. A oblong hole 37*a* which is long in a lateral direction is formed in a left end portion of the balance lever 37, and the balance lever 37 is rotatably connected to the rear end portion of the injection pipe 10 via the oblong hole 37*a* by the pin P5. An upper surface of the second lever bracket 39 is inclined forward down by the same angle as an angle of forward down incline in the injection pipe 10, whereby the balance lever 37 is rotated around a forward inclined vertical axis.

In FIG. 5, reference symbol 16*a* denotes a button type operation piece mounted to the front end portion of the operation device 16-1. In this case, the operation device 16-1 and the operation lever 36 may be connected by a ball joint having a spherical bearing. The others have approximately the same structures as those of the first embodiment mentioned above.

In accordance with the third embodiment mentioned above, when moving the operation device 16-1 in a direction of an arrow B (rearward) in FIG. 6, the lever 33 rotates in a direction of an arrow C, whereby the water stop valve 30 is operated so as to be opened, the operation lever 36 is simultaneously rotated in a clockwise direction (the direction of an arrow F) around the pin P4 via the link plate 35, the injection pipe 10 is moved to the front side via the pin P5, and the injection port 10*a* is exposed to the inside of the toilet A, whereby the washing water (service water) is injected upward from the injection port 10*a*.

In this case, when the operation lever 36 is rotated in the direction of the arrow F, the balance lever 37 is rotated in a counterclockwise direction (the direction of an arrow G) around the right end pin P6 via the pin P5, the pin P5 is held neutral in the lateral direction so as to move to the front side, and the injection pipe 10 is smoothly moved frontward. Further, when the left end portion of the operation lever 36 is biased to the upper side with respect to the connection piece 16 of the operation device 16-1 on the basis of the rotation of the operation lever 36 in the direction of the arrow F, the link plate 35 is bent in an S shape as shown by a solid line in FIG. 6, thereby allowing the left end portion of the operation lever 36 to be biased to the upper side.

Next, when moving the operation device 16-1 mentioned above in the direction opposite to the arrow B (forward) in FIG. 6, the lever 33, the link plate 35 and the operation lever 36 are rotated in the inverse direction to that mentioned above, and the injection pipe 10 is moved to the rear side, whereby the injection port 10*a* thereof is retracted from the toilet. Further, the water stop valve 30 is operated so as to be closed, whereby the washing water supply to the injection pipe 10 is stopped. In this case, the balance lever 37 mentioned above is rotated in a clockwise direction (the direction opposite to the arrow G) around the right end pin P6 via the pin P5, the pin P5 is held neutral in the lateral direction so as to move to the rear side on the basis of the resistance of the balance lever 37, and the injection pipe 10 is smoothly moved to the rear side.

FIG. 7 shows a fourth embodiment. In FIG. 7, reference numeral 16-1 denotes an operation device, and reference numeral 36 denotes an operation lever. These elements have approximately the same structures as those in the third embodiment mentioned above. Reference numeral 35-1 denotes a link plate connecting the connection piece 16*b* of the operation device 16-1 to the left end portion of the operation lever 36. The link plate 35-1 is formed by a hard plate material such as a sheet metal or the like, and a front end portion thereof is rotatably connected to the connection piece 16*b* by the pin P2. Further, a connection pin 40 is fixed to the left end portion of the operation lever 36 so as to protrude downward, and a lower portion of the connection pin 40 is fitted to a pin hole (not shown) formed in a rear end portion of the link plate 35-1 so as to freely rotate and vertically slide. In this case, the connection pin 40 may be fixed to a rear end portion of the link plate 35-1 so as to protrude upward, and the upper portion thereof may be fitted to the left end portion of the operation lever 36 so as to freely rotate and vertically slide.

Accordingly, when the operation piece 16-1 is moved in the direction of the arrow B (rearward) in FIG. 7, the operation lever 36 is rotated in the direction of the arrow F around the pin P4 via the link plate 35-1 mentioned above, as shown by a virtual line in the drawing. At this time, when the left end portion of the operation lever 36 is biased to the upper side with respect to the link plate 35-1 on the basis of the rotation of the operation lever 36 in the direction of the arrow F, the connection pin 40 mounted to the left end portion moves upward within a pin hole in the rear end portion of the link plat 35-1, as shown by a virtual line in FIG. 7, thereby allowing the left end portion of the operation lever 36 to be biased to the upper side. Accordingly, it is possible to smoothly convert the motion in the direction of back and forth of the operation piece 16-1 into the rotational motion of the operation lever 36. The others have approximately the same structures as the third embodiment mentioned above.

FIG. 8 shows a fifth embodiment. In FIG. 8, reference numeral 16-1 denotes an operation device, and reference numeral 36 denotes an operation lever. These elements have approximately the same structures as those in the third embodiment mentioned above. An engagement pin 41 is fixed to a right end portion of the connection piece 16*b* of the operation device 16-1 mentioned above so as to protrude upward. On the other hand, an oblong hole 36*a* in a lateral direction is formed in a left end portion of the operation lever 36, and the upper portion side of the engagement pin 41 is fitted to the oblong hole 36*a* so as to freely slide vertically and laterally.

Accordingly, when the operation piece 16-1 is moved in the direction of the arrow B (rearward) in FIG. 8, the operation lever 36 is rotated in the direction of the arrow F around the pin P4 via the engagement pin 41 mentioned above, as shown by a virtual line in the drawing. At this time, when the left end portion of the operation lever 36 is biased to the upper side on the basis of the rotation of the operation lever 36 in the direction of the arrow F, the oblong hole 36*a* formed in the left end portion moves to the upper side of the engagement pin 41. Further, when the left end portion of the operation lever 36 is biased in the lateral direction with respect to the engagement pin 41, the engagement pin 41 slides in the lateral direction within the oblong hole 36*a*. Accordingly, it is possible to smoothly convert the motion in the direction of back and forth of the operation piece 16-1 into the rotational motion of the operation lever 36. The others have approximately the same structures as the third embodiment mentioned above.

As is apparent from the description mentioned above, in accordance with the invention on the basis of the first aspect of the present invention, when moving the operation device provided in the side portion of the toilet seat in the direction of back and forth, the injection pipe comes in and out within the toilet. Further, when the injection pipe is protruded into the toilet, the water stop valve automatically opens and the washing water is injected from the injection port When the injection pipe is retracted from the inside of the toilet, the water stop valve automatically closes and the washing water supply from the injection port is stopped. Accordingly, it is possible to operate the washing machine without requiring any expensive parts and any electricity, it is possible to make the structure inexpensive, and it is possible to increase a safety without any electric leakage or the like. Further, it is possible to operate the washing machine on the basis of a simple operation.

Further, in accordance with the invention on the basis of the second aspect, since the interlocking mechanism is structured such that the drive rack and the driven rack are provided in the operation device and the injection pipe, and the pinions engaging with these racks and the transmission device connecting the pinions are provided, it is possible to accurately transmit the motion of the operation device to the injection pipe by the simple structure.

Further, in accordance with the invention on the basis of the third aspect, since the interlocking mechanism is structured such that the operation lever is provided between the operation device and the injection pipe so as to freely rotate around the vertical axis, one end portion of the operation lever is rotatably connected to the operation device, and another end portion of the operation lever is rotatably connected to the injection pipe, the structure can be made more simple.

In accordance with the invention on the basis of the fourth aspect, since the balance lever extending to the opposite side to the operation lever from the injection pipe is provided, one end portion of the balance lever is rotatably connected to the injection pipe, and another end portion of the balance lever is rotatably connected to the side of the support plate, it is possible to stabilize the operation of the injection pipe while making the structure simple.

Further, in accordance with the invention on the basis of the fifth aspect, since the water stop valve is constituted by the ball water stop valve, the water stop valve is opened and closed by a small rotating angle, the movement of the operation device in the direction of back and forth is reduced, and it is possible to make the structure compact.

What is claimed is:

1. A toilet seat with a washing machine comprising:

a support plate (6) provided in a rear portion of the toilet seat (2);

an injection pipe (10) provided on said support plate (6) so as to freely come out forward from said rear portion of the toilet seat (2) and return;

an arm (15) provided on said support plate (6) said arm protruding forward on one side portion of said toilet seat (2);

an operation device (16) provided on said arm (15) so as to freely move forward and backward;

an interlocking mechanism (20) interlocking the forward and backward movement of said operation device (16) with the forward and backward movement of said injection pipe (10);

a water stop valve (30) provided in said support plate (6), said water stop valve controlling the supply of water to said injection pipe (10); and a link mechanism (32) provided between said operation device (16) and said water stop valve (30), said link mechanism interlocking the forward and backward movement of the operation device (16) with the opening and closing operation of the water stop valve (30).

2. A toilet seat with a washing machine as claimed in claim 1, wherein the interlocking mechanism (20) is structured such as to comprise a drive rack (21) and a driven rack (22) respectively provided on the operation device (16) and the injection valve (10), a primary pinion (23) and a secondary pinion (24) engaging with said drive rack (21) and the driven rack (22), and a transmission device (25) for transmitting a rotation of said primary pinion (23) to said second pinion (24).

3. A toilet seat with a washing machine as claimed in claim 1, wherein the interlocking mechanism (20-1) is structured such that a laterally extending operation lever (36) is provided between the operation device (16-1) and the injection pipe (10) a laterally middle portion of said operation lever (36) is connected to the support plate (6) so as to freely rotate around a vertical axis, and one end portion of said operation lever (36) and another end portion thereof are respectively connected to said operation device (16-1) and said injection pipe (10) so as to freely rotate around the vertical axis.

4. A toilet seat with a washing machine as claimed in claim 3, further comprising a balance lever (37) extending to the opposite side to the operation lever (36) from the injection pipe (10), wherein one end portion of said balance lever (37) and another end portion thereof are respectively connected to said injection pipe (10) and a side of the support plate (6) so as to freely rotate around a vertical axis.

5. A toiled seat with a washing machine as claimed in any one of claims 1 to 4, wherein said water stop valve (30) is constituted by a ball water stop valve.

* * * * *